US006204653B1

(12) United States Patent
Wouters et al.

(10) Patent No.: US 6,204,653 B1
(45) Date of Patent: Mar. 20, 2001

(54) REFERENCE VOLTAGE GENERATOR WITH MONITORING AND START UP MEANS

(75) Inventors: Patrick August Maria Wouters, Hamme-Merchtem; Denis Dupeyron, Brussels, both of (BE)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/595,905

(22) Filed: Jun. 20, 2000

(30) Foreign Application Priority Data

Jun. 22, 1999 (EP) ..... 99401555

(51) Int. Cl.[7] ..... G05F 1/40
(52) U.S. Cl. ..... 323/313
(58) Field of Search ..... 323/282, 285, 323/313, 314; 327/534, 538, 539

(56) References Cited

U.S. PATENT DOCUMENTS 4,609,833 9/1986 Guterman .
5,751,142 * 5/1998 Dosho et al. ..... 323/316
5,773,967 6/1998 Tenten .
5,789,906 * 8/1998 Mizuide ..... 323/313
5,867,013 2/1999 Yu .
5,955,873 * 9/1999 Maccarrone et al. ..... 323/314

FOREIGN PATENT DOCUMENTS 0 714 055 A1 5/1996 (EP) .
0 840 193 A1 5/1998 (EP) .

OTHER PUBLICATIONS

"Analysis and design of analogue integrated circuits" of Paul R. Gray and Robert G. Meyer, John Wiley and Sons, New York (1993).

* cited by examiner

*Primary Examiner*—Matthew Nguyen
(74) *Attorney, Agent, or Firm*—Sughrue, Mion, Zinn, Macpeak & Seas, PLLC

(57) ABSTRACT

A voltage reference generator comprising operational amplifier means (7) associated with feedback circuit (8) for providing a stable voltage reference ($V_{BG}$) further includes start-up means (10) controlled by monitoring means (9) driven by said voltage reference, said monitoring means providing a voltage reference validation flag indicative of proper operation of said voltage reference generator.

11 Claims, 2 Drawing Sheets

REFERENCE VOLTAGE GENERATOR WITH MONITORING AND START UP MEANS

BACKGROUND OF THE INVENTION

The present invention relates to a voltage reference generator as is described in the preamble of the first claim.

Such a voltage reference generator is already known in the art, e.g. from the tutorial handbook "*Analysis and design of analogue integrated circuits*" of Paul R. Gray and Robert G. Meyer, John Wiley and Sons, New-York (1993). Therein on page 344, FIG. 4.49c, a bandgap reference circuit is shown, including an operational amplifier which relates to the operational amplifier means as described in the preamble of the first claim of the present document, associated in a feedback loop to a circuit consisting of the transistors Q1,Q2, and resistors R1,R2 and R3, corresponding to the feedback circuit, as well described in the preamble of the first claim of this document.

Such a configuration, as indicated by this prior art document on the same page, generates at its output terminal a reference voltage, but needs appropriate start-up circuitry in order to insure a stable operation point. The latter condition is of course necessary to ensure that the output voltage is the correct one. However, even in the presence of such a start-up circuit, some transients in the output voltage may occur and the output voltage can have the wrong value. Additional circuits relying on the voltage reference output voltage can thereby malfunction seriously and create erroneous or even hazardous situations. Examples are circuits for accurate analog power-on-reset functions for low supply level conditions, charging circuits for very sensitive Lithium-Ion batteries that need a very precise voltage limitation, circuits for generation of precise supply voltage levels using low drop-out regulators, etc.

At the same time, in applications where this voltage regulator is part of an integrated circuit, the total configuration needs to be as simple as possible because of cost and power consumption issues. This is for instance the case when the aforementioned applications are used in a GSM-chip.

SUMMARY OF THE INVENTION

An object of the present invention is thus to provide a voltage reference generator of the above known kind, but which solves the aforementioned problems.

According to the invention, this object is obtained by the fact that the voltage reference generator further includes monitoring as well as start-up means in the configuration described by the characteristic portion of the first claim.

By the fact that the start-up means is controlled itself by an output signal generated by the monitoring means, such that the complete configuration thereby provides an additional feedback of the reference output voltage signal to an input of the operational amplifier means itself, a self-sustaining stable system is obtained. At the same time the second output terminal of the monitoring means provides a validation flag indicative of the correct and reliable operation of the voltage reference generator, which can thus be interpreted by further circuitry. The total voltage reference generator thereby remains of a very low complexity, since only two additional blocks are added, which, as will be explained in a further paragraph of this document, can each be very simple.

Another characteristic feature of the present invention is described in claim 2.

In this way, by simultaneously monitoring two parameters of the operational amplifier means, a better, more accurate and full-proof indication of the correctness of the operation is obtained compared to the case where only one single parameter is monitored.

Still a further characteristic feature of the present invention is described in claim 3.

The second parameter thus consists of a current flowing through an output stage of the operational amplifier means. Comparison of this value with a predetermined threshold current level, results in a first authorisation flag, being an internal signal of said monitoring means. Thereby a first indication of the correct operation of the circuit is provided.

Yet another characteristic feature of the present invention is described in claim 4.

Similarly, the reference output voltage is compared to a predetermined threshold voltage level within a voltage monitoring means. This results in a second indication of the correct operation of the circuit.

Furthermore, referring to claim 5, an AND-type means is a simple means for guaranteeing that both authorisation flags simultaneously have to comply to certain values, such that an unambiguous validation flag is provided to the second output terminal of the voltage reference generator.

Another characteristic feature of the present invention is described in claim 6.

Thereby a simple embodiment of the aforementioned voltage monitoring means is described. It is important to notice that when the resultant output voltage is high, a high enough value of the reference output voltage is present. In this case an autonomous evolution of the internal voltage reference circuit, consisting of the operational amplifier means and the feedback circuit, towards the only correct table operating point is guaranteed, and a further regulation by the start-up means is inhibited. In the other case, when the resultant output voltage is low, the start-up means remains activated in order to force the internal voltage reference circuit towards its stable operating point.

In this respect the value of the predetermined threshold voltage level with which the reference output voltage is compared, is a design parameter related to the stable operating point, as is stated in claim 7. This will also be further explained in the descriptive part of this document.

Yet a further characteristic feature of the present invention is described in claim 8.

This presents a very simple embodiment of such a start-up means, reducing the cost of the overall voltage reference generator.

Other characteristic features of the present invention are described in claims 9, 10 and 11.

The output stage of the operational amplifier means and the current monitoring means are thereby similar in structure, consisting of a current source in series with an active element, for instance a transistor. Both transistors are grounded and controlled by the same signal, which is delivered at the second output terminal of the operational amplifier means. By designing the transistors of the output stage and the current monitor such that their current ratio equals th ratio of a first current and a second current, this first current being related to the current supplied by the first current source, this second current being the current delivered by the second current source, the current comparison function of the current monitor means is obtained. Indeed, the current monitor means has to check whether the current flowing through the output stage exceeds a predetermined threshold current level. This current flowing through the output stage is the current that flows when the first transistor is on. The first current is thereby equal to the current delivered by the first current source, minus the current delivered to the feedback circuit, in the stable operating region, and minus a predetermined current to a load. When the first transistor is on, it will thus carry the first current. Since the first and second transistors both receive the same driving signal, and since the ratios of their currents match with the ratio of the first and second currents, the output of the current monitor indicates whether the first current is sunk by the first transistor, thereby thus providing the current comparison function envisaged.

BRIEF DESCRIPTION OF THE DRAWINGS

These and other objects, advantages and features of the invention will become apparent from the following description thereof taken in conjunction with the accompanying drawings which illustrate a specific embodiment of the present invention.

DETAILED DESCRIPTION OF THE INVENTION

Bandgap voltage reference generators such as the voltage reference generator VRG of the present invention are widely used in electronics, in all cases where a fully integrated, precise and stable voltage reference is needed. This is a very general need in analog integrated circuits such as analog/digital or digital/analog converters, supply regulators, level detectors, power-on reset functions, analog timers, charger circuits, etc.

Bandgap voltage reference generators are known for a long time and extensively described in the specialised literature, such as in the referenced prior art document. Therein is already mentioned that a bandgap voltage reference circuit consisting of an operational amplifier means, and a feedback means, as is shown in their FIG. 4.49c, may have several operating points. This is highly undesirable, and provisions have to be taken in order to guarantee operation in only one of these points. Furthermore, an indication is to be foreseen as to the validity of the bandgap output signal. Indeed, in case the circuit is still not in its desired stable operating point, the value of the provided output voltage reference signal may be wrong. Additionally, the complete circuit still needs to be small for integration, especially e.g. into a GSM integrated circuit, where each $\mu$m2 is important.

Figure 1:
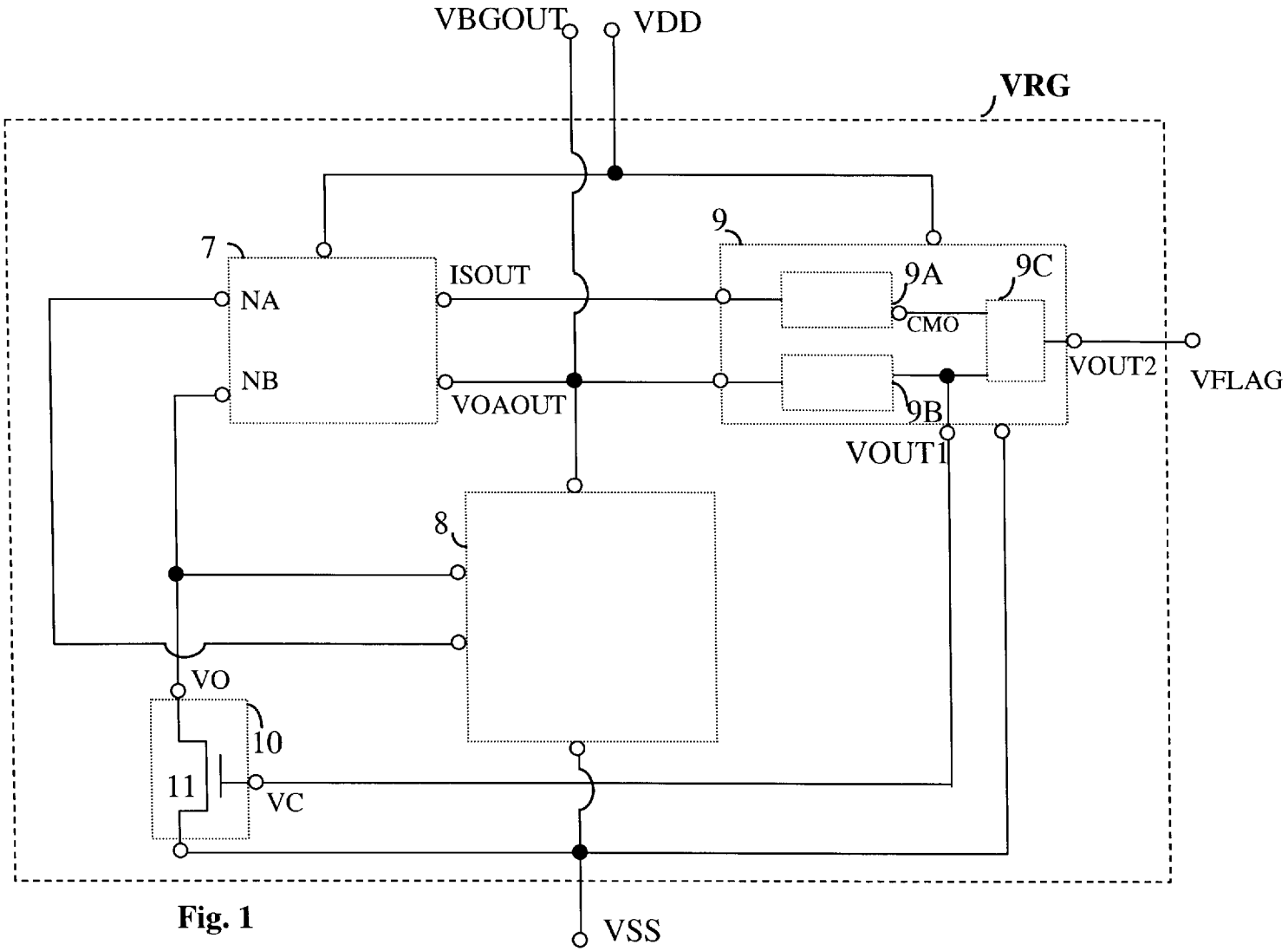
FIG. 1 is a block diagram of a voltage reference generator VRG according to the invention.

The bandgap voltage reference circuit of the present invention fulfills the aforementioned requirements. A basic scheme is shown in FIG. 1, wherein a voltage reference generator VRG is depicted. It includes a supply voltage terminal, denoted VDD, for coupling to a power supply, having a value of for instance 3.3 V, and a reference terminal, denoted VSS, for coupling to a reference potential, for instance the ground reference. This voltage reference generator further includes an operational amplifier means, denoted 7, of which a first, respectively a second input terminal, NA, resp. NB, are coupled to two output terminals of a feedback circuit, denoted 8. An input terminal of the feedback circuit is coupled to a first amplifier output terminal, denoted VOAOUT, of the operational amplifier means 7. This first amplifier output terminal VOAOUT is also coupled to a first output terminal VBGOUT of the voltage reference generator and provides the reference output voltage, hereafter denoted VBG.

In order to comply with the requirements of a single stable operating point, while at the same time providing an indication of the presence and validity of the voltage reference output signal, the voltage reference generator further includes a start-up means, 10, of which the operation is controlled by a first output signal provided by a monitoring means, denoted 9. This first output signal is provided at a first output terminal VOUT1 of this monitoring means, the control terminal of the start-up means 9 is denoted VC. An output terminal, denoted VO, of the start-up means is coupled to the second input terminal of the operational amplifier means 7, thereby controlling its operation. A third terminal of the start-up means is coupled to the reference terminal VSS.

The monitoring means 9 is further coupled between the supply and the reference terminals, VDD, resp. VSS, and includes two input terminals, a first one being coupled to the first ouput terminal VOAOUT of the operational amplifier means 7, and a second one coupled to a second output terminal, denoted ISOUT, of the operational amplifier means 7. Besides the first output terminal VOUT1, which was coupled to the start-up means, this monitoring means includes a second output terminal, denoted VOUT2, which provides a validation flag, the value of which is indicative of a correct value of the reference output voltage VBG. This second output terminal VOUT2 is coupled to a second output terminal, denoted VFLAG, of the voltage reference generator itself. At this output terminal, the indication of the correct operation of the complete structure is thus provided by means of a validation flag .

As can be further observed from the first figure, the monitoring means further includes 3 main building blocks : a current monitoring means, denoted 9A, a voltage monitoring means, denoted 9B, and an AND-type means, denoted 9C.

The current monitoring means 9A includes an input terminal which is coupled to the second input terminal of the monitoring means, and consequently to the second output terminal ISOUT of the operational amplifier means 7. The current monitoring means is adapted to compare a first current flowing internally through an output stage of the operational amplifier means, thus from the supply to the reference terminal, with a predetermined threshold current level. Thereby an output signal at an output terminal, denoted CMO, is provided, this output signal corresponding to a first authorisation flag in case this first current exceeds this predetermined threshold current level. How this is performed will be described in a further paragraph of this document.

The voltage monitoring means includes an input terminal which is coupled to the first input terminal of the monitoring means, and consequently to the first amplifier output terminal VOAOUT of the operational amplifier means. It further includes an output terminal which is coupled to the first output terminal VOUT1 of the monitoring means. The voltage monitoring means is adapted to compare the signal provided at VOAOUT, being the reference output voltage VBG, with a predetermined threshold voltage level, the result of the comparison being the signal provided at terminal VOUT1. The latter signal being such that in case VBG exceeds the predetermined threshold voltage level, the start-up means is not activated while the level of the signal itself provides a second authorisation flag. In case VBG is lower or equal than the predetermined threshold voltage level, the output signal is such that the start-up means is activated, while at the same time having a logical level such that the second authorisation flag is not provided.

The presence of both first and second authorisation flags is checked in the AND-means 9C. AND-type means are such that both authorisation flags are to be simultaneously present in order to obtain a valid output signal. The output terminal of the AND-type means is coupled to the second output terminal VOUT2 of the monitoring means; the signal provided thereon thus being indicative of a simultaneous compliance of both the sensed current and the sensed voltage with the criterion of being larger than the predetermined threshold current, resp. voltage. Since this signal also corresponds to the validation flag, provided at terminal VFLAG, two parameters of the operational amplifier means are thus monitored for providing an indication of the correct operation.

The operation of the voltage reference generator will now be explained in view of the embodiment which is shown on FIG. 2. It is to be remarked that this is not the only embodiment possible, and that a person skilled in the art, is able to generate other possible embodiments based on the functional description given above and the scheme of FIG. 1. It is also possible that in order to improve certain parameters, extra functional blocks, however not relevant to the invention, may be inserted in between the distinct blocks described until now.

Figure 2:
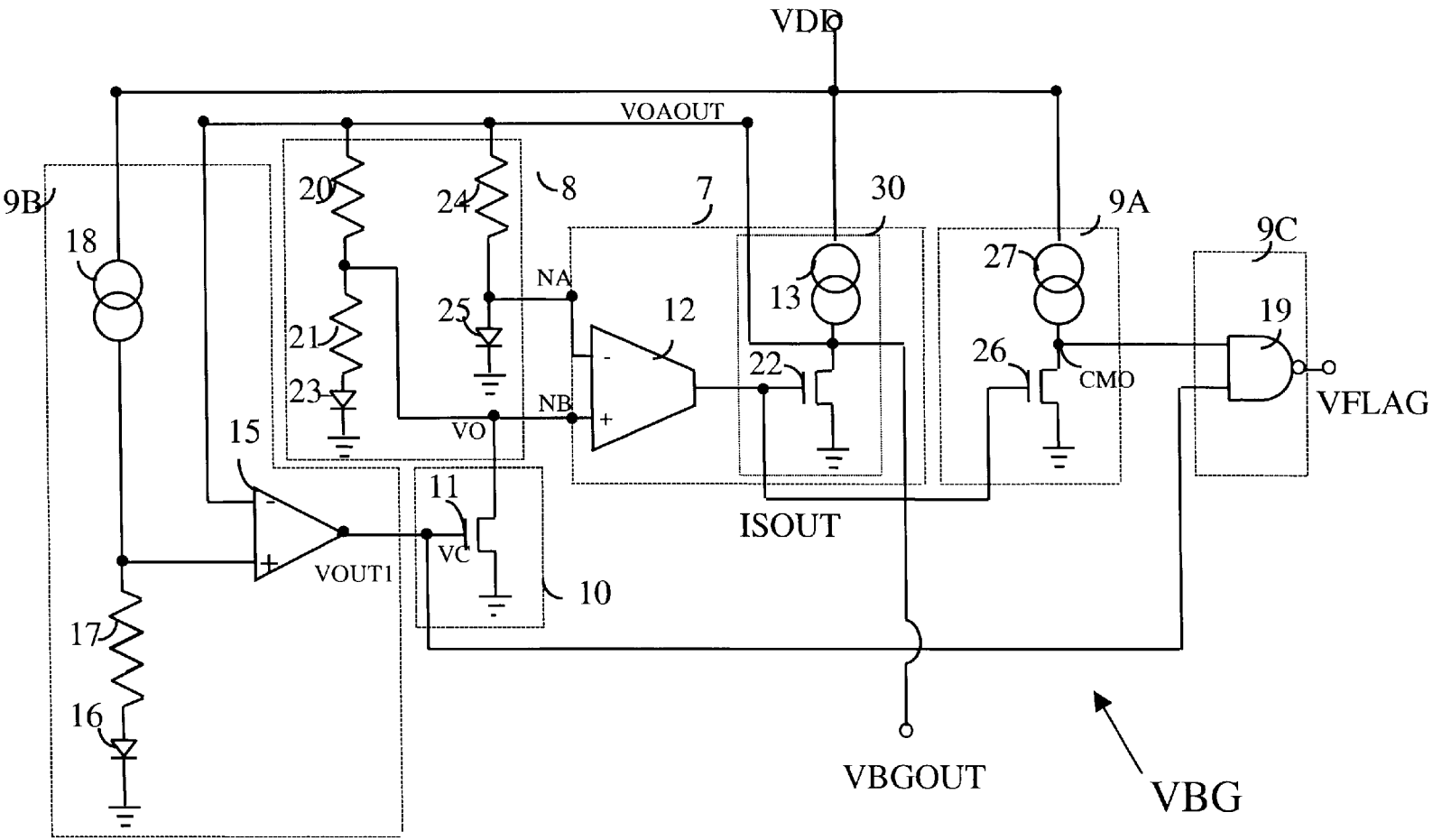
FIG. 2 depicts an embodiment of the voltage reference generator of FIG. 1.

In the embodiment of FIG. 2, the reference terminal VSS corresponds to the ground terminal, as is as such depicted.

The operational amplifier means 7 of FIG. 2 consists of an input amplifier stage 12, having a first and a second input terminal, respectively denoted with and and + and respectively coupled to the first NA and second NB input terminal of the operational amplifier means. The input amplifier stage further includes an output terminal , which is coupled to the second amplifier output terminal ISOUT. Although not depicted in FIG. 2 in order not to overload the drawing, this input amplifier stage is as well coupled between the VDD and the ground terminal. The second output terminal ISOUT of the amplifier means is coupled to a control input terminal of an output stage denoted 30, also included in the operational amplifier means 7. This output stage 30 consists of a first current source 13 in series with a first transistor 22, and coupled between the power supply terminal VDD and the ground reference terminal. The control terminal of the first transistor 22 is coupled to the output terminal of the input amplifier stage, whereas the intersection point between the first current source 13 and the conductive path of the first transistor, constitutes the first amplifier output terminal VOAOUT, which also constitutes the first output terminal VBGOUT of the embodiment of the voltage reference generator depicted in FIG. 2.

The feedback circuit 8 of FIG. 2 corresponds to the one referred to in the prior art document. It is coupled in a feedback configuration between the first amplifier output terminal VOAOUT, and both input terminals NA and NB of the operational amplifier means. Feedback circuit 8 includes resistor 24, coupled between VOAOUT and NA, whereby the latter junction point to NA is also further coupled via a diode 25 to the ground terminal. Feedback circuit 8 also includes two other resistors 20 and 21, the intersection point between them being coupled to NB, the other terminal of resistor 20 being coupled to VOAOUT, and the other terminal of resistor 21 being as well coupled to the ground terminal via another diode 23. The operation of the combination of an amplifier means and a feedback circuit as depicted in the embodiment of FIG. 2 is common prior art knowlegde concerning bandgap voltage generators, and will therefore not be discussed in this document.

Current monitoring means 9A has a structure similar to the output stage 30 of the operational amplifier means 7 . It includes a second current source 27 coupled in series with a second transistor 26 between the supply voltage terminal VDD and the ground reference terminal. The control terminal of the second transistor 26 is as well coupled to the second output terminal ISOUT of the amplifier means. This means that both first and second transistors are driven by the same voltage. By virtue of the operation of transistor 22, the value of this voltage relates to the current flowing through the output stage 30, in between VDD and the ground terminal. Indeed, in case the voltage at terminal ISOUT is lower than the threshold voltage of transistor 22, all current provided by current source 13 is fed to the feedback circuit 8 and possibly to a load coupled to output terminal VGBOUT (this load is not shown on FIG. 2), whereas almost no current flows through the transistor 22 of this output stage. When the voltage at the gate of transistor 22 exceeds its threshold voltage, another conductive path to the ground is created, resulting in current flowing from VDD to the ground through the output stage 30. Transistors 26 and 22 are designed such that the currents they carry comply with a predetermined ratio. In case of MOS transistors such as shown in FIG. 2, this is accomplished by means of selecting the width/length ratios of these transistors to match this predetermined ratio. In case of bipolar transistors, this is for instance accomplished by a sizing in the area of their emitters.

This predetermined ratio is thereby the same as the one between a first current related to the current supplied by the first current source, and a second current, which is supplied by the second current source. The first current is thereby equal to the current supplied by the first current source, minus the current flowing in the feedback circuit in the stable operating point of the voltage reference generator, and minus the current flowing through a load coupled to the first output terminal VBGOUT (this load is not shown on FIG. 2).

In the embodiment of FIG. 2, the start-up means 10 consists of an active device, for instance a transistor such as transistor 11, having a control terminal, in the embodiment of FIG. 2 constituting the control terminal VC of the start-up means. The conductive path of transistor 11 is coupled between the output terminal VO of the start-up means and the ground reference terminal. In the embodiment of FIG. 2, whereby transistor 11 consists of a nMOS transistor, the output terminal VO of the start-up means, which is further coupled to input terminal NB of the operational amplifier means, corresponds to the drain terminal of this transistor.

The AND-means 9C corresponds to a NAND-gate 19. This means that the output signal generated by it will only have a logical "high" value, in case its inputs both have a logical "low" or "zero" value.

The voltage monitoring means 9B mainly consists of a comparator, which, in the embodiment depicted in FIG. 2, consists of another operational amplifier 15. This comparator receives at its negative input terminal the voltage provided at the first output terminal VOAOUT of the operational amplifier means 7, and at its positive input terminal a predetermined threshold voltage which is generated by the series connection current source 18, a resistor 17 and a diode, coupled between the supply voltage terminal VDD and the ground terminal. This series connection thereby constitutes a threshold voltage providing means. The value of the predetermined threshold voltage provided by this threshold voltage providing means, is selected such as to lie in between the desired stable operating point, and its closest lower metastable operating point of the voltage reference generator, and taken into account all possible temperature and processing variations of the constituting components. For instance, in case a voltage reference output voltage of 1.2 V is envisaged, and knowing, for instance from computer simulations of this circuit, that the previous metastable operating point results in an output voltage of 0.6 V nominal, a threshold voltage of 0.9 V in chosen as lying in between both values, thereby taking into account these fluctuations in temperature, processing, etc. This value of 0.9 V is then obtained by selecting the current through 18 and the value of resistor 17 to be such that their product equals 0.3 V, provided that the built-in forward junction voltage of diode 16 is 0.6 V.

Since amplifier 15 is a differential amplifier with a high amplification factor, the difference between voltage at its input, corresponding to the difference between VBG, and this Predetermined threshold voltage, is amplified, thereby Providing an output signal at VOUT1.

The operation of the complete circuit will now be described.

The current monitoring circuit 9A realises a current comparator function, generating a digital output signal at CMO. When the current generated by transistor 26 is smaller than the second current sourced by the reference 27 the CMO output of the current comparator is pulled up to VDD (high digital level). Because the width/length ratios between transistors 26 and 22, and consequently their saturation currents they carry, correspond to the ratios between the second and first currents, CMO being pulled high indicates as well that still most current sourced by 13, into the output stage of the amplifier 7, is flowing into the feedback network, and possibly to the load (not shown in FIG. 2), thereby trying to raise the VBG output voltage at output terminal VBGOUT. This is a hard and forced condition for the start-up transistor 11, because it grounds the NB input of the amplifier 7 (which is coupled to the plus input of amplifier 12) for as long as the VBGOUT output voltage is not high enough, i.e. below the predetermined threshold voltage level generated by 16-17-18. As the plus input of amplifier 12 is grounded, its minus input can only be higher, and the output of amplifier 12 will clip to VSS. This turns of transistor 22 completely, thereby making sure that all available current in the output stage is flowing into the resistive feedback circuit. This condition is imposed for as long as the VBG at VBGOUT is not raised above the voltage threshold. Once VBGOUT exceeds the voltage threshold, comparator 15 will turn off transistor 11 because its output will clip now to VSS instead of to VDD previously. When this happens the start-up means releases the internal voltage reference circuit consisting of amplifier means 7 and feedback circuit 8, because now it is guaranteed that the VBG voltage has passed all undesired (meta)stable operating points, and can only evolve to the final VBG level of for instance 1.2V. By releasing the plus input of amplifier 12, the actual core of the reference voltage generator (7 and 8) is now allowed to "settle". While it is doing so, it will gradually turn on transistor 22 in the output stage. This is where the current monitoring comes into the picture, because this will now detect a certain amount of current flowing through transistor 22, high enough to ensure that the feedback loop is completely in regulation, and hence the output reference voltage VBGOUT is within a predetermined percentage, for instance 0.5% ,of its final accuracy.

The AND-means consisting of the NAND-gate 19, thereby checks the presence of two logical low values, one delivered by the current monitoring means and consisting of a first authorisation flag, a second by the voltage monitoring means and consisting of a second authorisation flag. When both flags are present, the output of the NAND-gate has a logical high-value and provides the final validation flag, indicative of the correct operation of the voltage reference generator.

It is to be remarked that, although in FIG. 2 all transistors are represented as MOS transistors, embodiments whereby they are replaced with bipolar transistors are also possible. A person skilled in the art knows how to adapt the circuits in case bipolar transistors are used.

It is further worthwhile to mention that also faulty conditions can be detected by means of this circuit, for instance in case the load shows a short-circuit condition. Indeed, at that moment, the current supplied by current source 13 will integrally flow through the load, whereby also the validation flag will never be obtained.

Other implementation for realising the current monitor, voltage monitor and start-up means are of course possible.

While the principles of the invention have been described above in connection with specific apparatus, it is to be clearly understood that this description is made only by way of example and not as a limitation on the scope of the invention, as defined in the appended claims.

What is claimed is:

1. Voltage reference generator (VRG) including a supply voltage terminal (VDD) for coupling to a power supply, a reference terminal (VSS) for coupling to a reference potential, an operational amplifier means (7) having a first input terminal (NA), a second input terminal (NB) and a first amplifier output terminal (VOAOUT) which is coupled to an input terminal of a feedback circuit (8) of said voltage reference generator, said voltage reference generator (VRG) including a first output terminal (VBGOUT) coupled to said first amplifier output terminal (VOAOUT) for providing a reference output voltage, characterised in that said voltage reference generator further includes monitoring means (9), adapted to monitor said reference output voltage, a first input terminal of said monitoring means thereby being coupled to said first amplifier output terminal (VOAOUT), said monitoring means (9) thereby including a first output terminal (VOUT1) which is coupled to a control terminal (VC) of a start-up means (10) further included in said voltage reference generator (VRG), said start-up means (10) including an output terminal (VO) which is coupled to said second input terminal (NB) of said operational amplifier means (7), said monitoring means (9) including a second output terminal (VOUT2) coupled to a second output terminal (VFLAG) of said voltage reference generator (VRG) for provision of a validation flag indicative of the correct operation of said voltage reference generator.

2. Voltage reference generator (VRG) according to claim 1 characterised in that said monitoring means (9) is further adapted to simultaneously monitor said reference output voltage and a second parameter of said operational amplifier means (7), a value related to said second parameter thereby being provided at a second output terminal (ISOUT) of said operational amplifier means (7) which is further coupled to a second input terminal of said monitoring means (9).

3. Voltage reference generator (VRG) according to claim 2 characterised in that said monitoring means (9) further includes current monitoring means (9A) an input terminal of which is coupled to said second input terminal of said monitoring means (9), said current monitoring means (9A) being adapted to provide a first authorisation flag on a current monitor output terminal (CMO) as soon as a current flowing through an output stage (30) of said operational amplifier means (7) which constitutes said second parameter, exceeds a predetermined threshold current level.

4. Voltage reference generator (VRG) according to claim 1 characterised in that said monitoring means (9) further includes voltage monitoring means (9B), an input terminal of which is coupled to said first input terminal of said monitoring means (9), said voltage monitoring means (9B) being adapted to provide a second authorisation flag on an output terminal coupled to said first output terminal (VOUT1) of said monitoring means (9) when said reference output voltage exceeds a predetermined threshold voltage level, and to activate said start-up means by providing a signal on said first output terminal of said monitoring means (9) when said reference output voltage is lower or equal than said predetermined threshold voltage level.

5. Voltage reference generator (VRG) according to claim 3 characterised in that said monitoring means (9) further includes AND-type means (9C), a first input terminal of which is coupled to said output terminal of said voltage monitoring means (9B), a second input terminal of which is coupled to said current monitor output terminal (CMO), said AND-type means being adapted to provide said validation flag at an output terminal coupled to said second output terminal (VOUT2) of said monitoring means (9) when said AND-type means simultaneously receives said first and said second authorisation flags.

6. Voltage reference generator (VRG) according to claim 4 characterised in that said voltage monitoring means (9B) further includes a comparator (15) with a first comparator input terminal coupled to said first amplifier output terminal (VOAOUT), a second comparator input terminal coupled to a threshold voltage providing means (16, 17, 18) adapted to provide said predetermined threshold voltage level, and a comparator output terminal coupled to said first output terminal (VOUT1) of said monitoring means (9), said comparator being adapted to provide said voltage authorisation flag at said comparator output terminal when said reference output voltage exceeds said predetermined threshold voltage level and to provide a signal at said comparator output terminal for activating said start-up means (10) as long as said reference output voltage is below this predetermined threshold voltage .

7. Voltage reference generator (VRG) according to claim 6 characterised in that said predetermined threshold voltage level uniquely determines one stable operating point of said voltage reference generator.

8. Voltage reference generator (VRG) according to claim 1 characterised in that said start-up means (10) includes an active device (11) a control terminal of which is coupled to said control terminal (VC) of said start-up means (10), a conductive path of which is coupled between said output terminal (VO) of said start-up means (10) and said reference terminal (VSS).

9. Voltage reference generator (VRG) according to claim 2 characterised in that said operational amplifier means (7) further includes an input amplifier stage, a first, resp. second input terminal thereof respectively coupled to said first (NA), resp. said second (NB) input terminal of said operational amplifier means, an output terminal thereof constituting said second output terminal (ISOUT) of said operational amplifier means (7).

10. Voltage reference generator (VRG) according to claim 3 characterised in that said output stage (30) of said operational amplifier unit (7) includes a first current source (13) in series with a first transistor (22), a control terminal of which is coupled to said second output terminal (ISOUT) of said operational amplifier means (7), a conductive controlled path of which is coupled between said first amplifier output terminal (VOAOUT) and said reference terminal (VSS).

11. Voltage reference generator (VRG) according to claim 10 characterised in that said current monitoring means (9A) further includes a second current source coupled between said supply voltage terminal (VDD) and said output terminal (CMO) of said current monitoring means (9A), said current monitoring means (9A) further includes a second transistor (26), a control terminal of which is coupled to said second output terminal (ISOUT) of said operational amplifier means (7), a conductive controlled path of which is coupled between said output terminal (CMO) of said current monitoring means (9A) and said reference terminal (VSS).

* * * * *